United States Patent [19]

Fonseca

[11] 4,324,560

[45] Apr. 13, 1982

[54] PYRITE REMOVAL FROM COAL

[75] Inventor: Anthony G. Fonseca, Ponca City, Okla.

[73] Assignee: Conoco Inc., Ponca City, Okla.

[21] Appl. No.: 127,346

[22] Filed: Mar. 5, 1980

[51] Int. Cl.[3] ..... C10L 9/02

[52] U.S. Cl. ..... 44/1 SR; 201/17; 209/172; 241/20

[58] Field of Search ..... 44/1 SR; 201/17; 241/19, 20

[56] References Cited

U.S. PATENT DOCUMENTS

| | | | |
|---|---|---|---|
| 3,252,769 | 5/1966 | Nagelvoort | 44/1 R |
| 3,540,662 | 11/1970 | Abel et al. | 241/19 |
| 4,076,505 | 2/1978 | Dessau | 44/1 SR |
| 4,081,251 | 3/1978 | Colli | 44/1 SR |

*Primary Examiner*—Carl F. Dees

*Attorney, Agent, or Firm*—Cortlan R. Schupbach, Jr.

[57] ABSTRACT

Pyrite is removed from coal by crushing, air classification and organic heavy medium separation. A superior method is taught wherein only a fraction of the total coal treated need be treated with organic media separation.

5 Claims, 3 Drawing Figures

PYRITE REMOVAL FROM COAL

Figure 1:
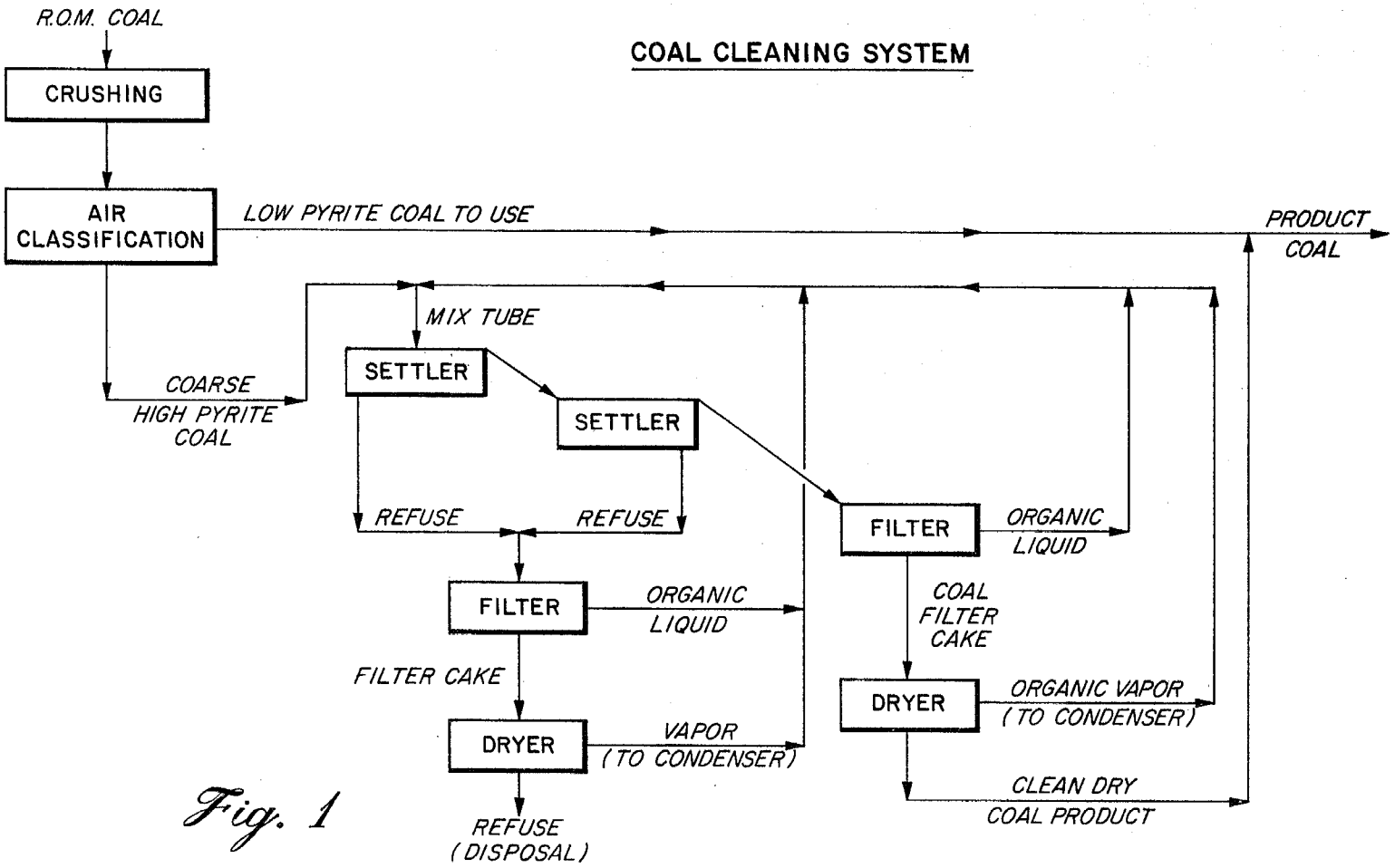

This invention relates to a method for removing pyrite from coal to place coal in acceptable useable form. More particularly, this invention relates to an improved method for recovering clean coal from raw coal containing pyrite by crushing to a fine size, air classifying to separate low pyrite fines, and using organic media separation to remove pyrite from the coarse pyrite-enriched fraction which remains.

As a worldwide shortage of oil begins to be felt, more and more energy demands have been placed upon the coal industry. Coal is primarily employed for conversion into chemical and thermo energy. However the coal mining industry has been put under pressure for some time by environmentally concious governments to remove large amounts of sulfur from coal. Low sulfur coal suitable for use by coal powered electric utilities is in short supply, particularly in the Eastern portions of the United States. This is a major disadvantage of coal which is mined in the United States, which has high sulfur content ranging up to about 5 weight percent. Removal of sulfur (pyrite) from coal is therefore one of the most pressing needs in related fields of energy and clean environment.

In addition, coals contain mineral matter (usually reported as ash in analysis) other than pyrite in amounts ranging from about 2 to about 40%. This mineral manner consists of a variety of non-combustible inorganic materials such as kaolinite, quartz, gypsum and other minerals such that its presence results in a lower fuel value for coal on a weight basis.

The coal mining industry has long used separation methods employing dense media for the reduction of pyrite content of coal. U.S. Pat. No. 3,768,988 describes a process which uses aqueous ferric sulfate or chloride to oxidize pyritic sulfur in coal to elemental sulfur which is then removed by solid extraction. A gravity concentration mineral separation is described in each of U.S. Pat. Nos. 2,150,899; 2,150,917; 2,150,918; 2,150,946; 2,150,947; and 2,151,578. U.S. Pat. No. 4,076,505 shows a method for reducing pyritic sulfur content of coal by contacting coal under sink-float conditions with a heavy organic medium containing a dispersant quantity of ionic surfactant and separating a coal float phase from the liquid medium to obtain a coal having lower pyrite content.

U.S. Pat. No. 3,696,923 shows a float system for recovering fine coal using a water flotation system. U.S. Pat. No. 3,807,557 likewise shows a method for floating pyrite from coal.

U.S. Pat. No. 3,540,662 teaches a method of using air classification to remove or grade coal into successive pyrite levels. A method for recovering coal from the high pyrite fraction is not taught. Air classification has been used by Bituminous Coal Research Inc. (BCR) and reported in BCR reports L-260; L-346; and L-296. However, the results of these reports in general showed low pyrite rejection and high coal rejection, based on the total coal process.

These methods are relatively complicated and are not in general economically attractive. Coal having an exceptionally low sulfur content and which is easily removed from other mining refuse is rapidly becoming a premium fuel of choice. Such demands upon the available supplies of such coal will greatly increase the needed amount of premium coal which meets environmental standards. Until cleaned of pyrite and until an economical method of separating from mining refuse has been found, approximately 90% of the coal in the United States is unattractive for use because of any of these considerations. Thus there remains a need for improved coal recovery from mining refuse.

It is therefore an object of the present invention to provide an efficient and economical process for obtaining coal from mining refuse and pyrite. Other objects will become apparent to those skilled in this art as the description proceeds.

DESCRIPTION OF THE INVENTION

Thus the present invention provides an improved method for the separation of pyrite and refuse from coal when a majority of said coal is less than 200 standard mesh by comprising (a) crushing said coal,
(b) passing said crushed coal through an air classifying means, said means separating said crushed coal into a fine fraction suitable for immediate use and a coarse pyrite rich fraction;
(c) contacting the coarse pyrite rich fraction with an organic heavy media;
(d) thoroughly mixing the organic media and coal;
(e) allowing the coal to separate in the organic media forming a sink organic phase and a float coal organic phase;
(f) recovering the float coal phase; and
(g) separating coal from the float coal organic phase.

The air classification means used in the process of the present invention is well known in this art and is exemplified by U.S. Pat. No. 3,540,662. This patent describes the use of sequential air classification systems to fractionate the finely divided coal into fractions containing various pyrite levels. In the process of the present invention, such fractions can be one or any number of fractions as desired. However, normally about 80% of the coal will be recovered as useable coal immediately and the remainder in coarse sizes will be used as a feed for the heavy organic media separation process.

The organic heavy media useful in the instant invention is any having a specific gravity sufficiently high to allow the separation of pyrite refuse from coal. Representative examples of such useful organic liquids are perchloroethylene, trichloroethylene, carbon tetrachloride, pentachloropropane, tetrachloropropane, 1,1,1-trichloroethane, chloroform, methylene chloride, 1,1,2-trichloroethane, 1,1,1,2-tetrachloroethane, and 1,1,2,2-tetrachloroethane. Other liquids can, of course, be used and are well known to those skilled in the art. Those mentioned are representative of the group as a whole. In addition, these liquids can be mixed with each other or with less dense hydrocarbon such as kerosene in order to produce an organic media having a very exacting density for specific operations.

After the initial air classification of finely divided coal, moisture is preferably kept low, usually below 5%. If this is not the case the insertion of a drier prior to heavy organic media system is used to achieve acceptable coal moisture. However, some coals cannot be dried. It has been discovered that a surfactant can be added at this point in the process to provide benefits in cleaning. However, such benefits are not as advantageous as when coal is actually utilized at low moisture levels. Air classification of fine coal to remove ash prior to the organic treatment of the instant invention is beneficial in that only a small portion of the air classified material need be subjected to heavy organic media treatment, normally, about 20% of the total coal treated. Thus, the invention provides a one pass cleaning system for coal. Dual systems and screening of mine coal can be eliminated.

GENERAL DESCRIPTION OF THE DRAWINGS

Figure 2:
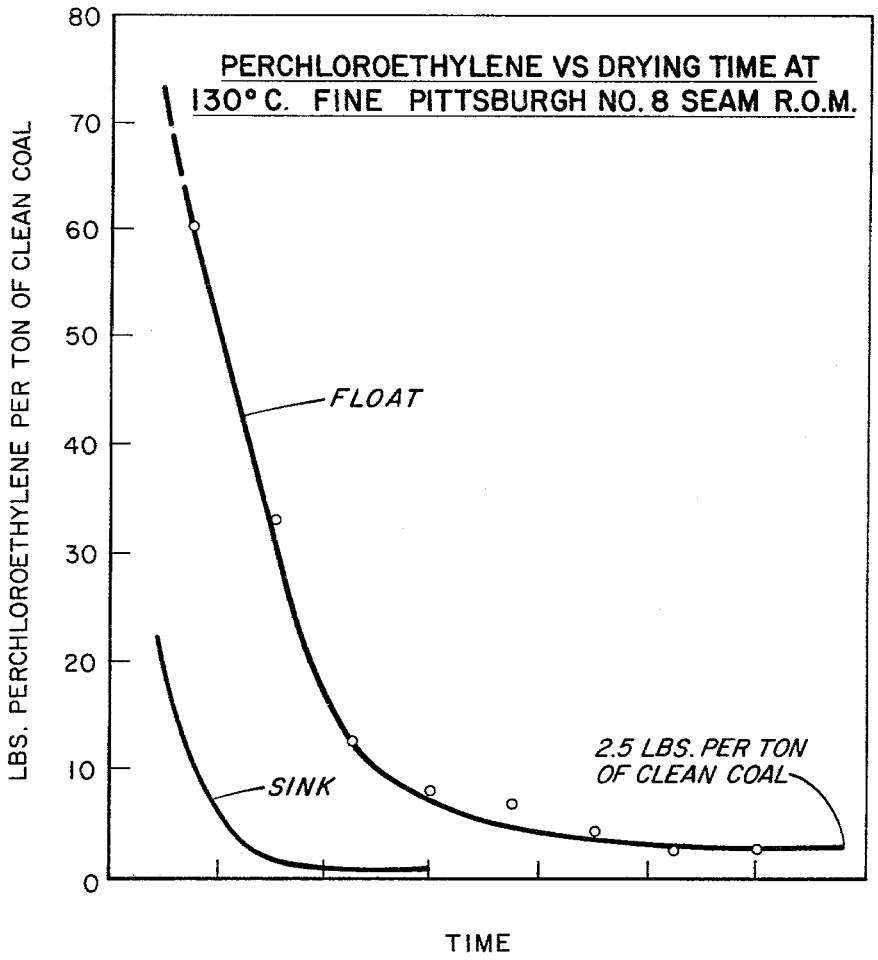

FIG. 1 generally describes the process of the instant invention wherein coal is crushed and air classified prior to treatment in an organic heavy media separation. FIG. 2 is a graph describing the drying time using perchloroethylene for fine coal.

Figure 3:
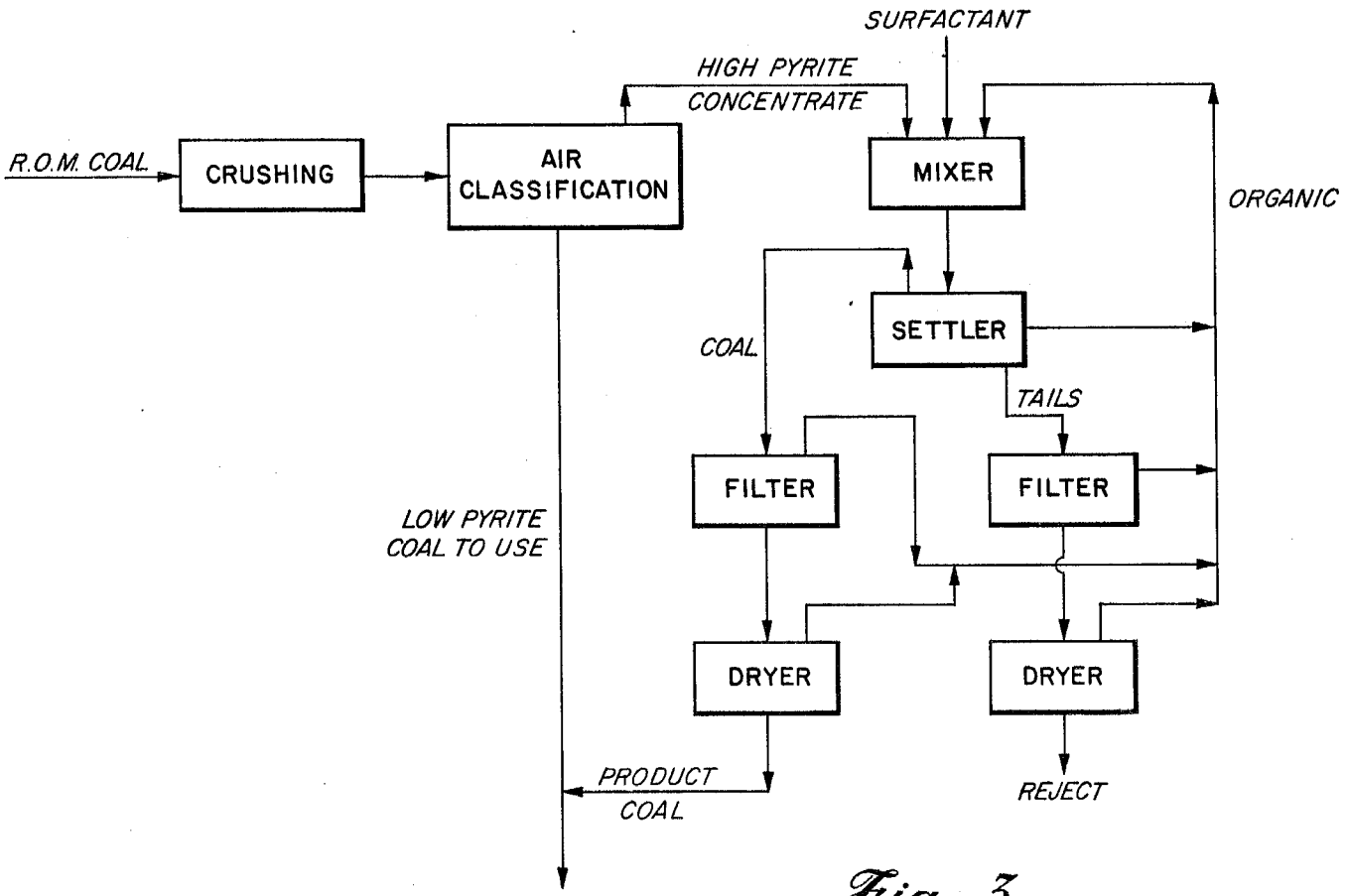

FIG. 3 is a flow diagram describing air classification followed by a surfactant treatment prior to organic heavy media separation in lieu of adequate or complete drying.

SPECIFIC DESCRIPTION OF THE DRAWINGS

FIG. 1 shows run of mine (ROM) coal (or previously cleaned coarse coal) being crushed, air classified, and subjected to an organic heavy media coal cleaning system. The coarse coal fraction passes into a mix tube after air classification wherein it is intimately mixed with an organic liquid. The stream being mixed with the organic liquid will comprise anywhere from 15 to 30% of the entire coal stream normally about 20% to about 30%. In lieu of a mix tube a mixing chamber using a propeller or paddle agitator is adequate. The coal/organic liquid mixture (or slurry) then goes into a settler system which can contain any desired number of settlers but normally will contain one or two. The refuse from both settlers is filtered to recover organic liquid which is then reused as the mix tube. The filtercake is then disposed. Normally a dryer is used to in order to recover organic vapors and avoid releasing them to the environment. The organic float from the settler is sent to a separation device which recovers organic liquid for reuse at the mix tube. The product of the dryer is a clean, dry coal having a high BTU recovery value and an extremely low pyrite content.

FIG. 2 is a graph showing the drying time of perchloroethylene at 130° C. for fine run of mine (ROM) coal or previously cleaned coarse coal. A vastly decreased drying time and drying energy requirement occurs when drying coal exposed to perchloroethylene compared to water. Much less energy is needed due to the low heat of vaporization of perchloroethylene versus water. The comparison of removing water from coal and perchloroethylene from coal shows that removal of one pound of water requires 1,134.8 BTU's while only 128.6 BTU's is required to remove a pound of perchloroethylene. Therefore, the BTU requirement necessary for water removal is 10 times that necessary for perchloroethylene removal, making the organic media highly preferable for the final pyrite separation.

FIG. 3 is a schematic diagram showing the separation of the bulk of the remaining refuse from coal if the moisture content is greater than 5–10%. This method uses a surfactant to permit improved separation. Use of low moisture coal via drying is preferred. The air classified coal is filtered and mixed with organic media with a suitable surfactant. The mixture is allowed to separate or settle. Coal is recovered and organics are recycled to the mixture. The tails are separated from the organics and discarded by the organic vapor recovery. The organic media is then again reused at the mixer.

The instant invention is more concretely described with reference to the examples below wherein all parts and percentages are by weight unless otherwise specified. The examples are provided to illustrate the instant invention and not to limit it.

EXAMPLE 1

Run of mine (ROM) Pittsburg #8 seam coal was crushed, pulverized and air-classified using a small commercial air classifier. Air classification was carried out at a rate of about 1100 pounds per hour and produced a 20% by weight coarse fraction and a 80% by weight fine fraction. The size distribution of these fractions is set forth in Table 1. Table 2 shows the absolute weight of these fractions on a combined (total) basis of a 100 gram sample.

TABLE 1

| | Size Distribution | |
|---|---|---|
| | Coarse (20% of total) | Fine (80% of total) |
| +200 mesh | 34.4 | — |
| 200 × 325 mesh | 44.5 | 1.3 |
| 325 × 400 mesh | 10.5 | 6.3 |
| −400 mesh | 10.5 | 92.5 |

TABLE 2

| | Size Distribution - Combined | | |
|---|---|---|---|
| | Coarse (absolute weight) | Fine (absolute weight) | |
| +200 mesh | 6.9 | — | |
| 200 × 325 mesh | 8.9 | 1.04 | |
| 325 × 400 mesh | 2.1 | 5.04 | |
| −400 mesh | 2.1 | 74.0 | |
| | 20.0 | 80.0 | grams |

The pyrite distribution within the coal sample classified in Tables 1 and 2 was determined. Table 3 shows pyrite distribution for the coarse and fine samples separately. Table 4 shows the size distribution by sample weight as a composite for the entire sample.

TABLE 3

| | Pyrite Distribution | | |
|---|---|---|---|
| | Wt % | Wt % Pyrites | Wt % Pyrite Distribution |
| Coarse (32.3 wt %) | | | |
| +60 mesh | 5.7 | 1.61 | 2.6 |
| +100 mesh | 8.2 | 1.74 | 4.4 |
| +200 mesh | 13.8 | 2.11 | 13.7 |
| +325 mesh | 2.8 | 8.91 | 12.3 |
| +400 mesh | 0.4 | 16.73 | 3.3 |
| −400 mesh | 1.4 | 5.78 | 3.9 |
| Fine (67.7 wt %) | | | |
| +60 | 0.0 | 0.0 | 0.0 |
| +100 | 0.2 | 0.81 | 0.1 |
| +200 | 2.2 | 0.62 | 1.2 |
| +325 | 11.8 | 1.01 | 5.8 |
| +400 | 6.2 | 1.61 | 4.9 |
| −400 | 47.3 | 2.11 | 47.8 |

TABLE 4

| | Size Distribution by Sample Weight | | |
|---|---|---|---|
| | Coarse | Fine | Composite |
| +60 mesh | 16.4 | 0.0 | 5.3 |
| +100 mesh | 26.0 | 0.0 | 8.4 |
| +200 mesh | 44.0 | 2.5 | 15.9 |
| +325 mesh | 10.0 | 18.4 | 15.7 |
| +400 mesh | 1.2 | 9.2 | 6.6 |
| −400 mesh | 2.4 | 69.9 | 48.1 |

EXAMPLE 2

A composite of organic floated 1.40 gravity (clean) coal and air classified coal having high pyrite rejection and high coal recovery was prepared. Previously cleaned (in preparation plant) coal was passed through an air classification, and the coarse coal recovered therefrom passed through a float/sink system using heavy organic media (perchloroethylene) to recover BTU values from the reject of the air classification system. Size distribution of the coal after crushing and before air classification are set forth as weight percent of total in Table 5.

TABLE 5

| Size Distribution Prior to Air Classification | |
|---|---|
| +200 mesh | 6.9 wt % |
| 200 × 325 mesh | 9.94 wt % |
| 325 × 400 mesh | 7.14 wt % |
| −400 mesh | 76.2 wt % |

Table 6 sets forth the coal composition for both the air classification fine and coarse coal fractions. The composition of air classification reject subjected to organic media float/sink is also presented.

TABLE 6

| Preparation Plant Product Coal (pre-cleaned) (Power Plant Pulverized Feed) | | Air Classification (fine coal) | | Air Classification Reject (coarse coal) | |
|---|---|---|---|---|---|
| | | Coarse | Fine | Float | Sink |
| Yield | | 20% | 80% | 77.5 | 22.5 |
| % Total Sulfur | 4.68 | 5.08 | 3.99 | 3.15 | 11.38 |
| % Pyrite Sulfur | 2.06 | 2.17 | 1.09 | 0.48 | 8.68 |
| % Ash | 12.4 | 12.97 | 17.22 | 4.66 | 41.27 |
| BTU | 12810 | 12640 | 11780 | 14030 | 7530 |

| | Precleaned Feed | Fine Fraction | Coarse Fraction |
|---|---|---|---|
| $SO_2$/MM BTU | 7.5 | 6.8 | 4.49 |

EXAMPLE 3

The test was repeated with previously cleaned (in preparation plant) Pittsburgh #8 Seam coal which had been crushed to a size of +200 m, 8.8%; 200×325 10.7%; 325×400 7.1%; −400 73.31%; and air classified into two fractions, one being a fine fraction of about 58% total by weight suitable for use, and 42% fraction total by weight which was subjected to the organic heavy media separation. The results of this procedure are set forth in Table 7.

TABLE 7

| Prep Plant Product Coal (Power Plant Pulverizer Feed) | | Air Classification | | Coarse | |
|---|---|---|---|---|---|
| | | Coarse | Fine | Float | Sink |
| Yield | | 42.5 | 57.5 | 80.1 | 19.9 |
| % Total Sulfur | 4.68 | 4.73 | 3.95 | 3.13 | 10.50 |
| % Pyrite Sulfur | 2.06 | 1.97 | 0.98 | 0.47 | 7.88 |
| % Ash | 12.4 | 12.74 | 18.55 | 4.79 | 43.70 |
| BTU | 12810 | 12660 | 11530 | 13920 | 7030 |

| | Prep Plant Cleaned Coal | Fine Fraction | Coarse Fraction |
|---|---|---|---|
| $SO_2$/MM BTU | 7.5 | 6.85 | 4.50 |

A composite analysis of the sulfur dioxide per BTU and yield of useable coal for each process was determined. This composite is set forth in Table 8.

TABLE 8

| Composite Product | Coal(1) | Example 2 | Example 3 |
|---|---|---|---|
| $SO_2$/MM BTU | 7.5 | 6.4 | 5.93 |
| Pyrite Sulfur % | 2.06 | 0.99 | .79 |
| Yield - BTU Recovery | | 95.5% | 91.5% |

(1)cleaned via standard dense media (heavy media) process.

The Table 8 data shows that the use of air classification and coarse fraction gravity cleaning can effect the reduction of from 7.5 pounds of sulfur dioxide per million BTU's for prep plant product coal or utility plant feed to 6.4 pounds of sulfur dioxide per million BTU or a 15% total sulfur reduction.

The instant process allows a removal of more than half of the total coal feed prior to treatment, thus saving much time and effort for the heavy gravity media separation. An immediate feed stream to consumption is provided, using a simple air classification method followed by heavy organic media separation.

It has also been discovered that the effect of moisture content of coal on the effectiveness of the heavy gravity media separation is very significant. It has been determined that moisture content on the surface of coal should be at or below 5% by weight in order for this method to be most effective. This significant effect is set forth in Table 9, which shows the increase in ash and pyrite sulfur with corresponding BTU's of product coal as moisture is increased. Poorer results are attributed to the agglomeration of some non-coal material with the coal due to poor surface wetting with the organic liquid. The reduction of surface moisture increases surface wetting of the organic liquid to the coal and apparently enhances ash and pyrite sulfur removal. The removal of water from the surface of the coal allows a quick, clean separation which is commercially feasible and can be continuously operated.

TABLE 9

| EFFECT OF MOISTURE ON SEPARATION ⅜ × O ROM Coal | | | |
|---|---|---|---|
| % Moisture | Coal Ash | Pyrite Sulfur | BTU |
| 2.5 | 8.62 | 1.44 | 13,430 |
| 5 | 10.15 | 1.45 | 13,190 |
| 7.5 | 12.37 | 1.66 | 12,820 |
| 12.5 | 15.71 | 2.0 | 12,260 |
| 15.0 | 15.46 | 1.73 | 12,330 |
| Feed - | 21.7 | 2.09 | 11,340 |

The effect of moisture on the process of the present invention begins to be felt when moisture of the coal is reduced below about 5% by weight and preferably below about 2.5% by weight. However, preferred ranges are from about 1 to about 2.5% by weight and especially less than 2.5% by weight. This moisture reduction is particularly significant for coal sizes such as ⅜, 28 mesh, and very finely divided coal.

The amount of organic heavy media remaining on the coal after treatment but before drying is about 60 pounds per ton. Drying after treatment reduces the organic content to about 2½ pounds per ton. These figures are based on perchloroethylene but would be very similar for most organic medias of sufficient density for operation in the instant process. FIG. 2 is a graphic representation of organic liquid remaining on product coal and refuse material (based on the tonage of clean coal) with drying time.

When moisture content of coal is above 2½%, surfactant can be applied instead of drying. Surfactant can also be used as partial replacement for drying, but the results are not as good as when surface moisture is removed. Use of a surfactant would show about a 12.9% ash residue as opposed to about an 8.6 ash residue with predrying when passing through the heavy media organic system. FIG. 3 shows the flow diagram for use of surfactant instead of drying following the air classification process in combination with an organic heavy media system.

Thus the process of the instant invention provides many benefits over the systems previously used. Initially, the system is rapid in the cleaning of the coal, requiring only a portion of the original coal be sent to the heavy media separation system. The heavy media separation system itself is rapid in the cleaning of coal, especially when surface moisture is reduced, requiring less residence time than other commercial systems. Black water coal and finely crushed coal can be adequately and rapidly cleaned by the instant system. When drying is used, the system does not require surfactant. The system does not require water during heavy media separation. The heavy media contact of coal is based instead upon air classification of the majority of the coal, followed by surface wetting of the residue high-pyrite fraction.

While certain embodiments and details have been shown for the purpose of illustrating this invention, it will be apparent to those skilled in this art that various changes and modifications may be made herein without departing from the spirit or scope of the invention.

I claim:

1. A method for the separation of pyrite and refuse from coal when a majority of said coal is crushed to a suitable size for air classification, comprising (a) crushing said coal to a suitable size;

(b) passing said crushed coal through an air classifying means, said means separating crushed coal into a fine, low pyrite fraction suitable for immediate use and a coarse, pyrite-rich fraction and drying said coarse fraction to a surface water content of not more than 5% by weight.

(c) contacting the coarse pyrite rich fraction with an organic heavy media selected from the group consisting of perchloroethylene, trichloroethylene, carbon tetrachloride, pentachloropropane, tetrachloropropane, 1,1,1-trichloroethane, chloroform, methylene chloride, 1,1,2-trichloroethane, 1,1,1,2-tetrachloroethane, and 1,1,2,2-tetrachloroethane.

(d) thoroughly mixing the organic media and coal;

(e) allowing the coal to separate in the organic media forming a sink pyrite-rich refuse phase and a float coal phase;

(f) recovering the float coal phase; and (g) separating coal from the float coal phase.

2. A method as described in claim 1 wherein the organic heavy media is recovered from the sink organic phase and reused in (c).

3. A method as described in claim 2 wherein the organic heavy media recovered from (f) is reused in (c).

4. A method as described in claim 3 wherein the water content of the coal is from about 2.5 to about 5% by weight prior to step (c).

5. A method as described in claim 3 wherein up to about 80% by weight of the coal is crushed to a size of about −200 mesh prior to air classification.

* * * * *